US008827145B2

(12) United States Patent
Hultberg et al.

(10) Patent No.: US 8,827,145 B2
(45) Date of Patent: Sep. 9, 2014

(54) OPENING ARRANGEMENT FOR A BOX

(75) Inventors: Lennart Hultberg, Åstrop (SE); Lars Sonesson, Ramlösa (SE)

(73) Assignee: McNeil AB, Helsingborg (SE)

( * ) Notice: Subject to any disclaimer, the term of this patent is extended or adjusted under 35 U.S.C. 154(b) by 366 days.

(21) Appl. No.: 12/917,941

(22) Filed: Nov. 2, 2010

(65) Prior Publication Data

US 2012/0097736 A1 Apr. 26, 2012

(51) Int. Cl.
*B65D 5/54* (2006.01)
*B65D 5/42* (2006.01)

(52) U.S. Cl.
USPC ..... 229/200; 229/154

(58) Field of Classification Search
CPC .. B65D 85/1054; B65D 5/6688; B65D 5/723; B65D 5/0281; B65D 5/16; B65D 5/68; B65D 83/06
USPC ..... 229/200, 220, 125.12, 210, 129.1, 125; 206/270, 540, 800, 468, 738; 221/31, 221/65, 302, 305; 222/476, 477
See application file for complete search history.

(56) References Cited

U.S. PATENT DOCUMENTS 2,128,196 A 8/1938 Vogel
2,426,911 A 9/1947 Williamson
3,337,116 A * 8/1967 Nowak ..... 229/125.28
3,356,279 A * 12/1967 Root ..... 206/427

(Continued)

FOREIGN PATENT DOCUMENTS

DE 4212323 A1 10/1993
DE 20302162 A1 6/2004

(Continued)

OTHER PUBLICATIONS

International Search Report mailed Jan. 5, 2012 for corresponding Application No. PCT/SE2011/051232.

(Continued)

*Primary Examiner* — Gary Elkins
*Assistant Examiner* — Christopher Demeree
(74) *Attorney, Agent, or Firm* — Karen G. Horowitz

(57) ABSTRACT

A box for a quantity of loose objects is provided with a dispensing opening that inhibits and preferably prevents objects from becoming caught within the box in the process of being dispensed. The box comprises walls enclosing a chamber for carrying a quantity of loose objects. A tab is defined, preferably by a weakening line, in a first wall of the box, such that the tab forms a flap when the weakening line is broken or the tab is otherwise separated from the first wall. Then the flap is hingedly attached to the first wall of the box by the aid of an attachment line between the ends of the weakening line. The flap is then pivotable into the chamber of the box after the weakening line has been broken. The tab has a breadth in a direction substantially parallel to the attachment line and a height in a direction substantially perpendicular to the attachment line. The tab height from a free edge thereof to the attachment line is preferably longer than the distance between the attachment line and an edge between the first wall (in which the tab is defined) and a second wall to which the flap formed from the tab is pivoted. Thus, the flap blocks entrance of the objects into an area between the flap and the walls to which the flap is pivoted so that objects are not trapped within the box upon dispensing of the objects.

23 Claims, 5 Drawing Sheets

(56) References Cited

U.S. PATENT DOCUMENTS

| | | | | |
|---|---|---|---|---|
| 3,423,005 | A | 1/1969 | Leibson et al. | |
| 3,568,911 | A * | 3/1971 | Bebout | 206/738 |
| 3,788,876 | A | 1/1974 | Baker et al. | |
| 3,843,037 | A | 10/1974 | Susuki et al. | |
| 4,194,632 | A | 3/1980 | Dutcher | |
| 4,479,588 | A | 10/1984 | Davis et al. | |
| 4,508,226 | A | 4/1985 | Davis et al. | |
| 4,566,627 | A | 1/1986 | Gendron | |
| 4,646,960 | A * | 3/1987 | Challand | 206/259 |
| 4,718,553 | A | 1/1988 | Adamoli et al. | |
| 4,746,052 | A | 5/1988 | Schmissrauter | |
| 4,746,061 | A | 5/1988 | Arvanigian | |
| 4,945,708 | A | 8/1990 | Curiel | |
| 5,042,653 | A | 8/1991 | Ems | |
| 6,983,875 | B2 | 1/2006 | Emmott | |
| 8,020,751 | B1 | 9/2011 | Emmott | |
| 2003/0085265 | A1 | 5/2003 | Haim | |
| 2005/0029336 | A1 | 2/2005 | Wende | |
| 2005/0103654 | A1 * | 5/2005 | Hennessy | 206/270 |
| 2005/0145683 | A1 | 7/2005 | Alagna et al. | |
| 2006/0131205 | A1 | 6/2006 | Sandberg et al. | |
| 2006/0289328 | A1 | 12/2006 | Hession | |
| 2008/0245698 | A1 | 10/2008 | Young | |
| 2009/0107873 | A1 | 4/2009 | Cotton et al. | |
| 2011/0162330 | A1 | 7/2011 | Cotton et al. | |
| 2011/0180432 | A1 * | 7/2011 | Blick et al. | 206/265 |
| 2012/0097736 | A1 | 4/2012 | Hultberg et al. | |

FOREIGN PATENT DOCUMENTS

| | | | |
|---|---|---|---|
| EP | 2192046 | B1 | 6/2010 |
| WO | WO 2006/079192 | A1 | 8/2006 |
| WO | WO 2006/131830 | A1 | 12/2006 |
| WO | WO 2008/054305 | A1 | 5/2008 |
| WO | WO 2008/062304 | A1 | 5/2008 |
| WO | WO 2008/086272 | A1 | 7/2008 |
| WO | WO 2008/091544 | A1 | 7/2008 |

OTHER PUBLICATIONS

International Search Report mailed Feb. 3, 2012 for corresponding Application No. PCT/SE2011/051233.

* cited by examiner

OPENING ARRANGEMENT FOR A BOX

CROSS REFERENCE TO RELATED APPLICATION

The present application is related to co-pending patent application Ser. No. 12/917,896, filed on even date herewith, and incorporated by reference herein in its entirety as if fully set forth herein.

FIELD OF THE INVENTION

The present invention pertains, in general, to the field of packets, and, specifically, to a package in the form of a box for a quantity of loose objects More particularly, the present invention pertains to an opening arrangement for such a box, said box enclosing a chamber for carrying a quantity of loose objects.

BACKGROUND OF THE INVENTION

Packages, such as boxes, have been proposed heretofore for carrying and dispensing individual objects from a quantity of loose objects one at a time through an opening in the package.

With regard to packages for carrying objects comprising pharmaceutical agents, such as chewing gums comprising nicotine, it is of great importance to have a tamper-evident opening. In this way, the consumer, and buyer of the package, will know that the content has not been manipulated since packaging, and that the right amount of objects is present in the package.

Prior art packages have used openings created by the breakage of indicative score lines, such as perforations, for this purpose, such that the breakage of the score line will result in the creation of a non-reversible opening in the package. In this way, tamper evidence has been assured.

U.S. Pat. No. 4,194,632 discloses a dispensing carton with a top closure panel hingedly connected to the front wall of the carton. The top closure panel has a tab tacked into sealing engagement with the edge of the bottom panel surrounding the dispensing opening. The top closure panel has lateral panels extending into the interior of the carton. The dispensing opening is resealed by returning the top closure panel back into abutting engagement with the bottom panel. However, the dispensing opening of the dispensing carton disclosed in U.S. Pat. No. 4,194,632 must be placed adjacent the edge of the top closure panel and the bottom panel to ensure that objects to be dispensed do not get stuck in the angle between the bottom panel and the front or back wall. Also, it is difficult to control the number of objects dispensed, since the front or back wall fully coincides with the edge of the dispensing opening, thus not allowing for gradual dispensing action.

International patent application WO 2006/131830 discloses a rigid packet for loose tablet-type sweets and chewing gums, composed of an outer casing and an inner casing with a small opening, wherein the inner casing is slidably arranged in the outer casing. Thus, the packet can shift between an open configuration and a closed configuration, wherein the opening is concealed by the outer casing. However, the rigid packet disclosed in WO 2006/131830 is provided with an opening wherein loose objects tend to get stuck in the angle between the bottom panel and the front or back wall. Also, it is difficult to control the number of objects dispensed, since the front or back wall fully coincides with the edge of the dispensing opening, thus not allowing for gradual dispensing action. Furthermore, the rigid package in WO 2006/131830 does not have a tamper evident opening.

Thus, there is a need for a novel box for containing and dispensing a quantity of loose objects, such as chewing gums, lozenges, tablets, sweets etc. More particularly, there is a need for a new opening arrangement for such a box, enclosing a chamber for carrying a quantity of loose objects, allowing for tamper evidence, while simultaneously allowing for the placement of a dispensing opening on parts of the side, top, bottom, front, or back wall other than adjacent an edge between two of these walls without risking that objects get stuck in an angle there between, and allowing for gradual dispensing of the objects.

SUMMARY OF THE INVENTION

Accordingly, the present invention preferably seeks to mitigate, alleviate, or eliminate one or more of the above-identified deficiencies in the art and disadvantages singly or in any combination and solves at least the above-mentioned problems by providing a box for a quantity of loose objects, said box comprising: walls enclosing a chamber for carrying said quantity of loose objects, and a tab that forms a flap positionable with respect to the walls so that objects are readily dispensed from the box without becoming caught or trapped behind the flap in a corner formed between the flap and one or more walls of the box near the flap. In accordance with one embodiment, a tab may be defined by a weakening line in a first wall of the box, such that the tab forms a flap when the weakening line is broken. The flap may be hingedly attached to the first wall of the box by the aid of an attachment line between the ends of the weakening line, such that the flap is pivotable into the chamber of the box after the weakening line has been broken. The tab has a breadth in a direction substantially parallel to the attachment line and a height in a direction perpendicular to the attachment line. Preferably, the breadth is selected to maintain the flap formed upon breaking the weakening line in an optimal position that inhibits and preferably prevents objects from becoming caught or trapped behind the flap in a corner formed between the flap and one or more walls of the box near the flap.

Thus, according to one aspect of the present invention, a box is provided allowing for tamper evidence.

According to another aspect of the present invention, a box is provided allowing for the placement of a dispensing opening on parts of the side, top, bottom, front, or back wall other than adjacent an edge between two such walls.

According to another aspect of the present invention, a box is provided allowing for gradual dispensing of objects.

According to another aspect of the present invention, a box is provided allowing for the placement of a dispensing opening on parts of the side, top, bottom, front, or back wall other than adjacent an edge between two of these walls without risking that objects get stuck in an angle formed there between.

According to another aspect of the present invention, a box is provided allowing for improved maintaining of an opening flap in an open position.

According to another aspect of the present invention, a box is provided allowing for improved maintaining of an opening flap in an open position, while still allowing for the maintaining of the objects inside the box.

BRIEF DESCRIPTION OF THE DRAWINGS

These and other aspects, features, and advantages of which the invention is capable will be apparent and elucidated from the following description of embodiments of the present invention, reference being made to the accompanying drawings, in which.

DETAILED DESCRIPTION OF EMBODIMENTS

Figure 1:
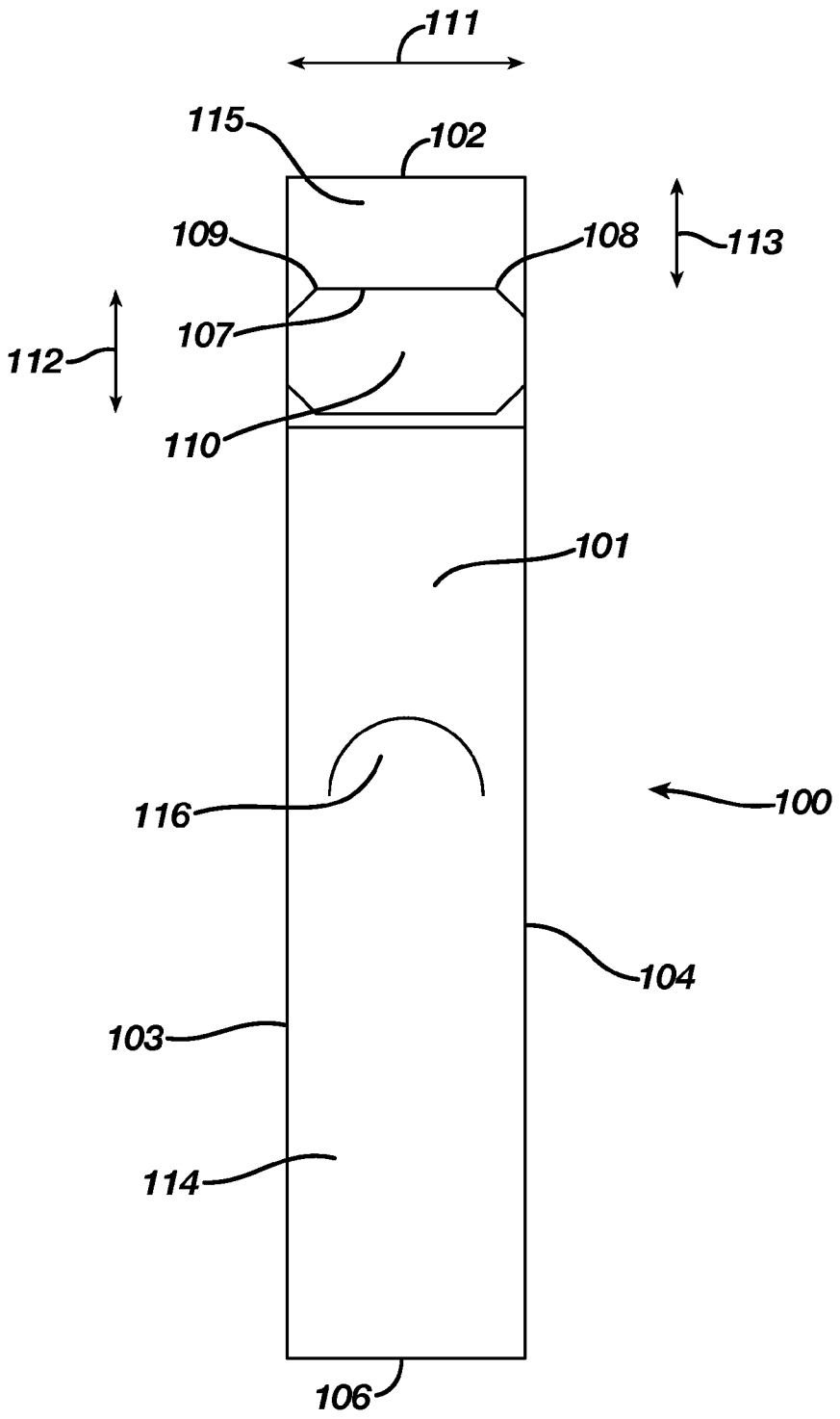
FIG. 1 is a front view of a box according to one embodiment of the present invention.
Figure 2:
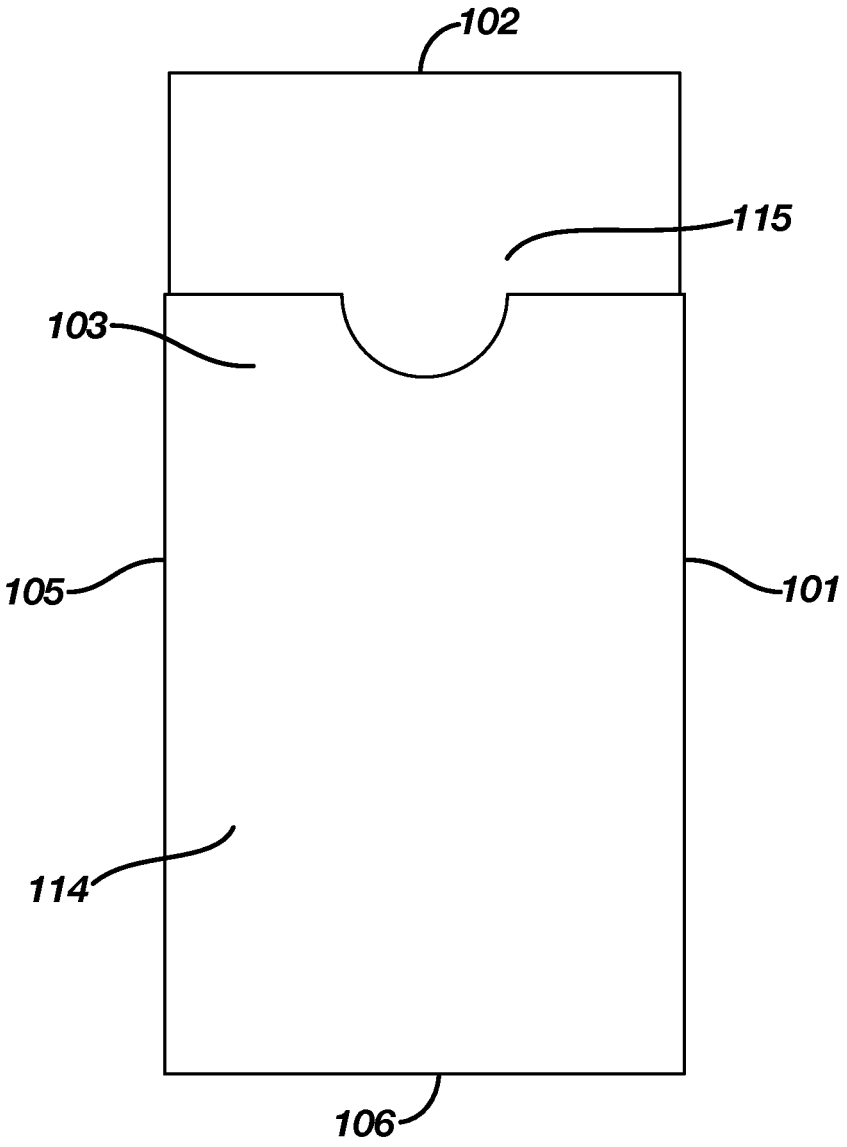
FIG. 2 is a side view of a box according to one embodiment of the present invention.

The following description focuses on an embodiment of the present invention applicable to a box for carrying and dispensing loose objects, and in particular to a box for carrying and dispensing chewing gums comprising nicotine. However, it will be appreciated that the invention is not limited to this application, but may be applied to many other dispensing boxes without departing from the scope of the present invention, such as for example boxes for carrying solid or semi-solid objects, such as pharmaceutical dosage forms comprising one or more substances for treating tobacco dependence, such as nicotine and any form thereof, and boxes for dispensing, for example, lozenges, tablets, sweets, etc.

According to a first embodiment, illustrated in FIGS. 1 to 4, a box 100 for carrying a quantity of loose objects is provided. The box 100 is typically manufactured by folding a blank, and may be manufactured from a foldable material selected from the group comprising carton, paper, polymers (such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), and a liquid crystal polymer), and any combination of these materials. When the box 100 is a carton, paper, or cardboard box, the manufacturing costs may be kept low, while simultaneously keeping a satisfactory strength for multi-packaging of multiple boxes. When the box 100 is formed from polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), the reaction between the box and the contents thereof (e.g., nicotine) may be minimized.

The walls of the box may also be a laminate of at least two sheets, each of which sheet is of a material selected from the group consisting of carton, paper, polymers (such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), and a liquid crystal polymer), and any combination of these materials.

The inner side of the walls may be coated with a material suitable for keeping the interior of the box dry and oxygen tight. A suitable material for coating the inner part of the walls of the box is a metal foil, such as aluminum foil.

The box 100 is a right angled six-sided box with a front wall 103, a back wall 104, side walls 101, 105 connecting opposite edges of front wall 103 and back wall 104, and end walls 102, 106 between side walls 101, 105 and front wall 103 and back wall 104, respectively. The walls of box 100 enclose a chamber for carrying objects, particularly loose objects.

When box 100 is a six-sided, right-angled box according to the exemplary embodiment illustrated in FIGS. 1 to 4, packaging and transportation of multiple boxes is improved, since six-sided, right-angled boxes are volume effective in multi-packaging. However, the shape of box 100 and the number of walls constituting the boundaries of box 100 may differ. In this respect, the number of walls of box 100 may be two (2), three (3), four (4), five (5) etc., whereby the walls are not necessarily planar, and the angles between the walls are not necessarily right-angles, as long as the walls define a chamber for carrying preferably a quantity of loose objects.

In one of the side walls, e.g., a first side wall 101, a tab 110 defined by at least one weakening line is provided. The weakening line may be a notch line or a perforation line. A notch line is, in this context, intended to be interpreted as a line of a continuous or discontinuous notch, where a notch does not pass through the whole thickness of the material, but only through a part of the thickness of the material, while a perforation line in this context is intended to be interpreted as a line of perforation(s), where a perforation passes through the whole thickness of the material. When the weakening line is a perforation line or notch line, such weakening line may be created in the same processing step as when the blank to be folded into the box 100 is performed. A perforation or notch cutting tool may be arranged in a suitable position with respect to the cutting tool for cutting out the blank, or may be incorporated into the die for cutting the blank. The exemplary weakening line of FIG. 1 has two weakening line ends 108, 109. Also, when the weakening line is a notch line, the chamber of the box may be kept isolated from the surroundings, thus having a set environment for the objects held therein. In the case of objects comprising nicotine, such a set environment may be very beneficial, since the nicotine may react with components in the surrounding ambient air.

Figure 3:
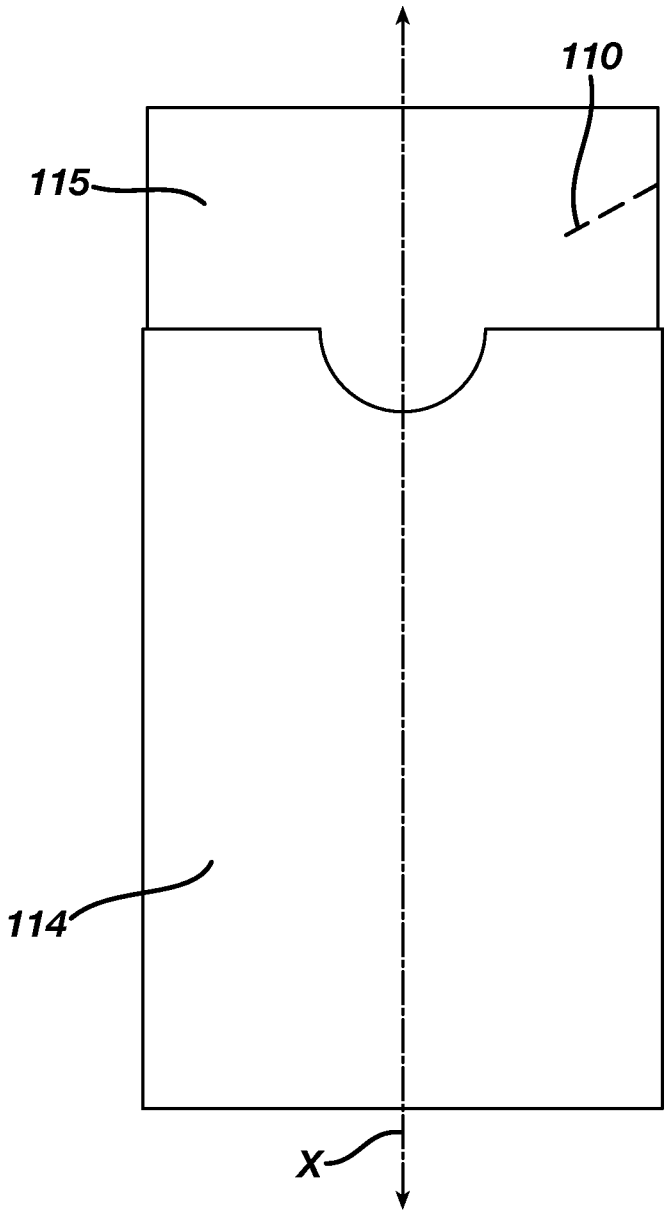
FIG. 3 is a side view of a box according to one embodiment of the present invention, wherein a pivoted flap is shown with a phantom line in an intermediate position as the flap is pivoted into a final open position
Figure 4:
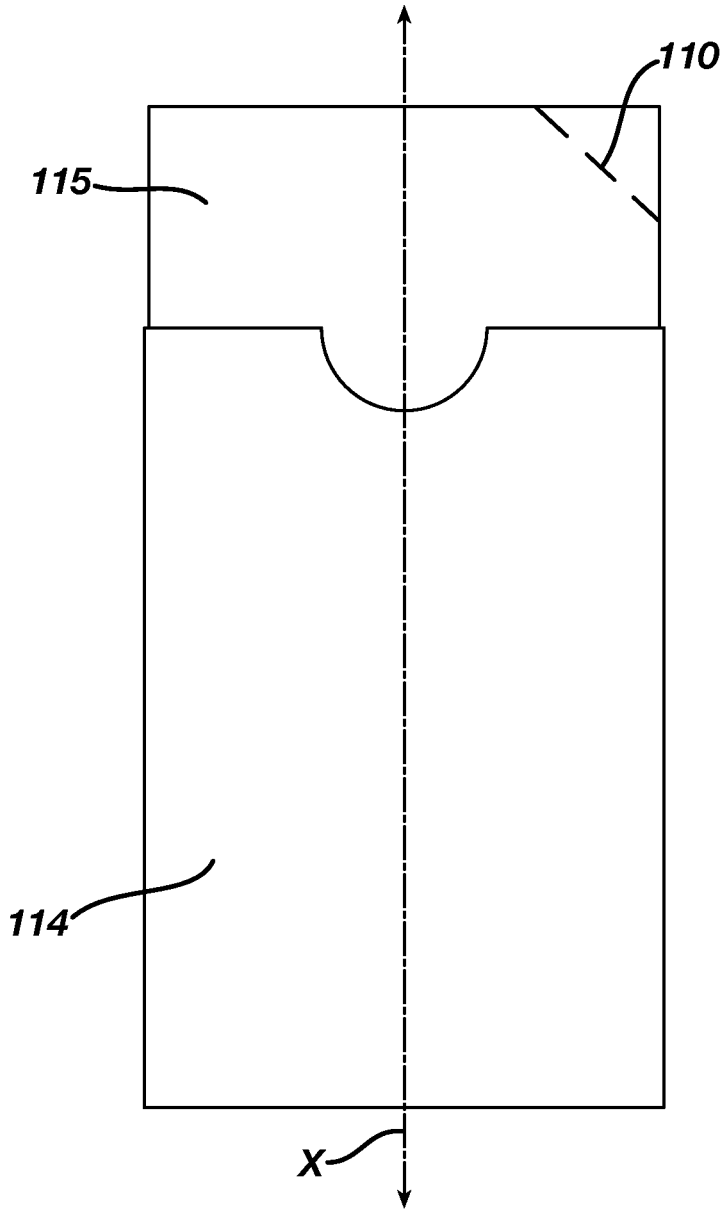
FIG. 4 is a side view of a box as in FIG. 3, but with the flap pivoted into a final open position.

In use, the weakening line is broken, such that tab 110, defined by the weakening line, forms a flap. The flap will be hingedly attached to the side wall in which tab 110 is formed, i.e., first wall 101 of box 100, by the aid of an attachment line 107 created between the ends of weakening lines 108, 109. The flap is then pivotable into the chamber of box 100 after the weakening line has been broken, as illustrated in FIG. 3 by a phantom line indicating the flap in a pivoted position as it is moved into an open configuration.

Tab 110 may be substantially right-angled in shape, such as substantially rectangular in shape, such that the flap created after the breakage of the weakening line is also substantially right-angled, such as substantially rectangular in shape. Tab 110 and the flap formed there from will have a breadth 111 in a direction extending between front wall 103 and back wall 104 (and along side wall 101), preferably substantially parallel to attachment line 107, and a height 112 in a direction substantially perpendicular to attachment line 107. In this way, the contact surface of the flap with the inside surface of front wall 103 and back wall 104 may be increased, allowing for improved securement of the flap in an open position. In a preferred embodiment, the height of the flap (measured from attachment line 107 to the free end of the flap) is greater than the distance from attachment line 107 to the top end of first wall 101 (at which first wall 101 is joined to second wall 102). In such embodiment, the free end of the flap engages second wall 102 at a distance from the point at which first wall 101 and second wall 102 are joined, thereby blocking an area behind the flap and between the corner formed by the intersection of first wall 101 and second wall 102. A flap formed in such manner thereby reduces the likelihood of objects getting trapped within box 100 instead of being dispensed there from.

In other embodiments of the present invention, the form of tab 110 and the flap may be selected from the group comprising triangle shape, multi-angle shape, oval, or round, or any other suitable shape that may achieve the desired effect of the present invention.

Tab 110 and the flap formed there from may have a height 112 that is greater than a distance 113 between attachment line 107 and an edge between the first wall 101 and an end wall, such as second end wall 102. The flap will then be pivotable into the chamber towards second end wall 102 and into engagement with the inner surface of second end wall 102 to facilitate securement of the flap in the open position. When the number of sides of box 100 is less than six (6), the angle between two sides may be decreased, allowing for a shorter distance between the walls, resulting in a shorter pivoting distance for the flap until the flap contacts the inner surface of the wall towards which the flap is pivoted.

Breadth 111 of tab 110 may be substantially equal to the breadth of first wall 101. When the breadth of the flap equals the breadth of first wall 101, a contact between the inner walls of front wall 103 and back wall 104 and the side edges of the flap may be achieved, allowing for securement of the flap in an open position. When tab 110 and the flap formed there from are substantially right-angled, such as rectangular, and the breadth of the flap is substantially equal to the breadth of first wall 101, the contact between the inner surfaces of front wall 103 and back wall 104 with the side edges of the flap may be increased, allowing for improved securement of the flap in an open position.

In another embodiment, tab 110 and the flap formed there from have a breadth 111 greater than the breadth of first wall 101, such that the weakening line extends somewhat around the edges between first wall 101 and front wall 103 and back wall 104. In this way, the flap will not perfectly fit in between the distance between front wall 103 and back wall 104, whereby it will be somewhat concavely curved on the side of the flap facing the substantial part of the chamber. More particularly, if the flap is wider than the distance between front wall 103 and back wall 104, the flap will become concavely curved in a direction facing the opening in first wall 101 and the side edges of the flap will engage front wall 103 and back wall 104 to resist movement of the flap back towards the first wall 101.

Box 100 may further comprise at least one outer casing 114, and at least one inner casing 115 telescopingly received within outer casing 114. The tab 110 defined by the weakening line is then arranged on inner casing 115, such as in the manner described above. Inner casing 115 is accommodated slidably within outer casing 114, capable of movement thus between a first closed configuration and a second open configuration. In the closed configuration, inner casing 115 is retracted and outer casing 114 is located over tab 110, defined by the weakening line, concealing tab 110 completely. In the open configuration, inner casing 115 is slidably extended a certain distance out from outer casing 114, as illustrated in the exemplary embodiments of FIGS. 1 to 3, with tab 110, defined by the weakening line, exposed at least in part. In the open position, the weakening line may be broken, thus forming a flap, such as in the manner described above. The flap may then be pivoted into the chamber within box 100, such as in the manner described above. Since the flap is pivoted inwardly into the chamber within box 100, inner casing 115 may still be slid into a closed position within outer casing 114, by retracting inner casing 115 into outer casing 114. Outer casing 114 will then be positioned over the opening formed by pivoting the flap into the chamber within box 100. In this way, tamper evidence, in the form of the breakage or non-breakage of the weakening line, is assured while simultaneously assuring easier and controlled dispensing of the objects carried in the chamber within box 100, and while also providing a closing mechanism for keeping the objects within the box.

In one embodiment outer casing 114 appears as a right angled parallelepiped with a rectangular base, forming a bottom of box 100, and a side wall made up of four faces. Outer casing 114 presents an open end opposite to the bottom and serving to accommodate inner casing 115. Inner casing 115 appears, likewise, as a parallelepiped having a rectangular base, forming a top of box 100, a side wall made up of four faces, and an open end opposite the rectangular base. Tab 110 defined by the weakening line will then be arranged on one of the four faces of the side wall of inner casing 115.

Inner casing 115 is inserted into outer casing 114 with its open end first, such that the base of inner casing 115 will form the top of box 100 and the base of outer casing 114 will form the bottom of box 100. Inner casing 115 may be sized to fit only part of the way into outer casing 114, even in the closed configuration, without reaching to the bottom of outer casing 114. Inner and outer casings 115, 114 combine to delimit the chamber within box 100 and within which products are contained. It will be appreciated that the volume of the chamber within box 100 may be varied as the mutually slidable casings 114, 115 are displaced one relative to the other. The chamber within box 100 communicates with the outside by way of the opening formed when the flap is pivoted into the chamber towards the base of inner casing 115 or the top of box 100. Thus, the one of the four faces of the side wall of inner casing 115 in which tab 110 is formed will represent the first wall 101 according to the embodiment disclosed in FIGS. 1 to 3, while the base of inner casing 115 or the top of box 100 will represent the second wall 102 in the embodiment disclosed in FIGS. 1 to 3. Inner casing 115 slides along a longitudinal axis X of box 100 (illustrated in FIG. 3) between the retracted condition, i.e., closed configuration, mentioned above, and the open condition illustrated in FIG. 3.

In the closed configuration, the edge of the side wall of outer casing 114 defining the open end of outer casing 114 is substantially flush with the edge between the side wall and the base of inner casing 115. The opening formed by pivoting the flap formed by tab 110 into the chamber within box 100 will be breasted by a side wall of outer casing 114. In an open configuration, inner casing 115 is slid outwardly from outer casing 114, such that the opening formed by pivoting the flap formed by tab 110 into the chamber within box 100 is exposed above the edge of the side wall of outer casing 114 defining the open end of outer casing 114.

In one embodiment, inner casing 115 has a closed end opposite the rectangular base, such that yet another rectangular base is obtained instead of the open end. In this embodiment, the environment inside the box may be better isolated from the surroundings, whereby objects comprising substances sensitive to the surroundings, such as nicotine, may be better kept and the shelf life thereof improved.

Stabilizing means may be interposed between inner casing 115 and outer casing 114, serving to stabilize the open and the closed configuration, respectively, such that box 100 will neither open accidentally when not in use, nor close accidentally while the contents are being dispensed. Such stabilizing means function by exploiting the pliable nature of the material from which they are made, generally carton, paper, laminate, Barex® (Barex® being a copolymer of acrylonitrile and methacrylate), or plastic. In this instance, such means could therefore be described as flexible stabilizing means. More exactly, the stabilizing means comprise at least one connecting appendage hinged to the side wall of the outer casing 114 and to the side wall of the inner casing 115, which is breasted in sliding contact with the aforementioned side wall of the outer casing 114. The appendage may for example be attached to the edge defining the open end of the inner casing 115 and on the other end of the appendage the appendage may be attached to the inner side of the side wall of the outer casing 114. An example of stabilizing means that may be used in the present invention is shown and described in WO 2006/13183, such as at page 7, line 23 until about page 10 and FIGS. 8A, 8B and 8C.

Figure 5:
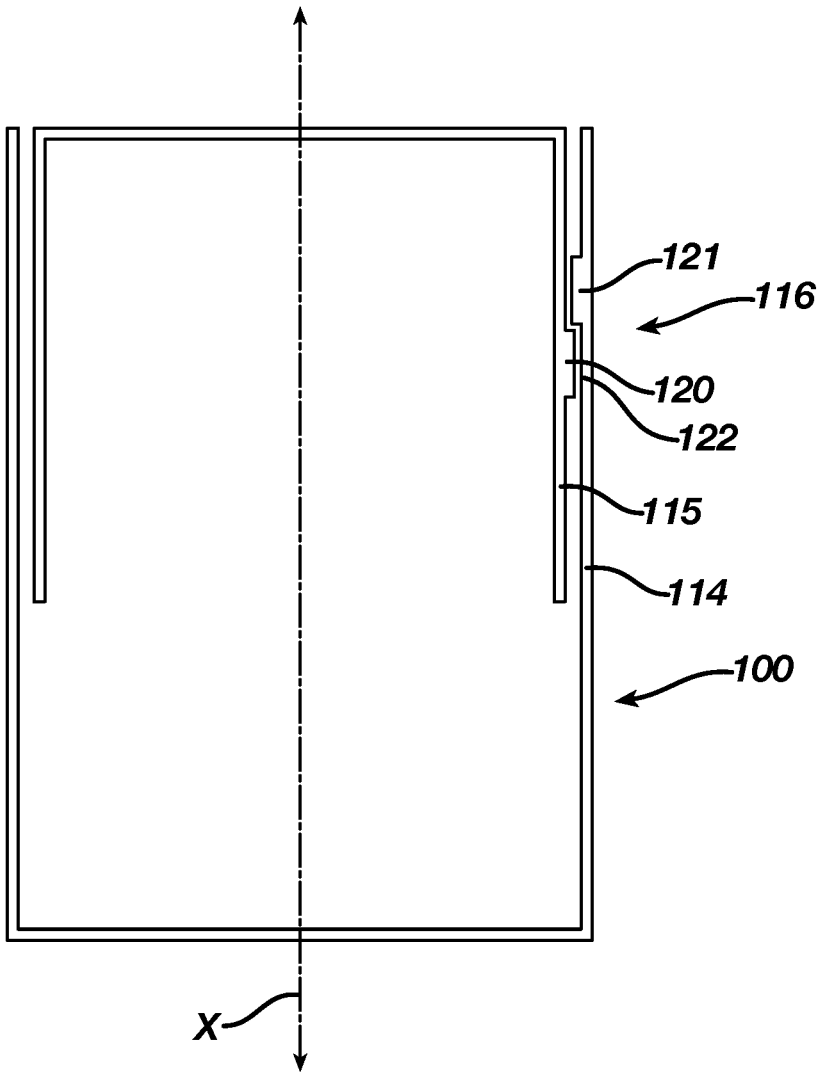
FIG. 5 is a sectional side view of a box according to one embodiment of the present invention.

In the exemplary embodiment of FIG. 5, a lock member 116 is illustrated. The lock member 116 may be created by providing a raised edge 120 on the outside of the side wall of inner casing 115, such as formed as a part of first wall 101. In a closed configuration of box 100, i.e., when inner casing 115 is in a retracted position in outer casing 114, the raised edge 120 of inner casing 115 engages a corresponding raised edge 121 on the inside of a corresponding side wall of outer casing 114, such as the inside of a portion of outer casing 114 formed as a part of the first wall 101. When the raised edge 120 on inner casing 115 is pushed inwardly, it will loosen engagement with the raised edge 121 on outer casing 114, whereby inner casing 115 will be outwardly slidable along longitudinal axis X, illustrated in FIG. 5. Pushing of the raised edge 120 on inner casing 115 will be facilitated by marking the corresponding position on the outside of box 100. Pushing of the raised edge will further be facilitated by a through slot 122 in the side wall of outer casing 114 at said corresponding position, such that the slot substantially corresponds to the engagement position in at least one point on the slot. Thereby it will be possible to push the raised edge 120 on inner casing 115 further inwardly without simultaneous movement of outer casing 115 in the same direction. Preferably the slot 122 is curved, whereby pushing is further facilitated.

Although the present invention has been described above with reference to specific embodiments, it is not intended to be limited to the specific form set forth herein. Rather, the invention is limited only by the accompanying claims and, other embodiments than the specific above are equally possible within the scope of these appended claims. Various additions, modifications, and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

What is claimed is:

1. A box for carrying a quantity of loose objects, said box comprising:

walls enclosing a chamber for carrying said quantity of loose objects; and a flap defined within a first wall of said box, said flap being hingedly attached to said first wall of along an attachment line such that said flap is pivotable into said chamber of said box along said attachment line and towards a second wall coupled to an edge of said first wall at an angle, said flap having a breadth in a first direction and a height in a second direction substantially perpendicular to said breadth and extending from said attachment line to a free end of said flap;

wherein:

said attachment line is spaced apart from and runs along the direction of said edge of said first wall to which said second wall is coupled;

said height of said flap is greater than a distance between said attachment line and said edge of said first wall to which said second wall is coupled; and said box comprises at least one outer casing, and at least one inner casing accommodated slidably within said outer casing while said flap is pivoted into said chamber of said box, said outer casing and inner casing being capable of relative movement between a first closed configuration and a second open configuration, wherein (i) said outer casing comprises a base presenting a bottom of said box, a side wall, and an open end opposite to said base and serving to accommodate said inner casing and (ii) said inner casing comprises a base presenting a top of said box and a side wall wherein said first wall is formed from said side wall of said inner casing.

2. The box according to claim 1, wherein:

said box is a right angled six-sided box with a front wall, a back wall spaced apart from said front wall, a first side wall connecting opposite first edges of said front wall and said back wall, a second side wall spaced apart from said first side wall and connecting opposite second edges of said front wall and said back wall spaced apart from said opposite first edges, a first end wall between said side walls and said front wall and said back wall, respectively, and a second end wall spaced apart from said first end wall and between said side walls and said front wall and back wall, respectively;

said first wall is one of said side walls, said front wall, or said back wall; and said second wall is one of said end walls.

3. The box according to claim 2, wherein said second wall is said top of said box.

4. The box according to claim 2, wherein said inner casing further comprises an open end opposite said base thereof.

5. The box according to claim 2, wherein said box is a package for solid or semi-solid pharmaceutical dosage forms.

6. The box according to claim 2, wherein the outside of a side wall of said inner casing and the inside of a corresponding side wall of outer casing both comprise a raised edge such that when said inner casing is in a retracted position in outer casing, the raised edge of the inner casing engages the corresponding raised edge on the inside of a corresponding side wall of outer casing.

7. The box according to claim 1, wherein said flap is substantially right-angled, multi-angled, oval, or round.

8. The box according to claim 1, wherein said breadth of said flap is at least equal to the breadth of said first wall.

9. The box according to claim 1, wherein said flap is formed by a tab defined in said first wall by a weakening line.

10. The box according to claim 9, wherein said weakening line is a non-penetrating weakening line.

11. The box according to claim 10, wherein said non-penetrating weakening line is a notch line.

12. The box according to claim 1, wherein said second wall is said top of said box.

13. The box according to claim 12, wherein said inner casing further comprises an open end opposite said base thereof.

14. The box according to claim 12, wherein said box is a package for solid or semi-solid pharmaceutical dosage forms.

15. The box according to claim 1, wherein said inner casing further comprises an open end opposite said base thereof.

16. The box according to claim 1, wherein said inner casing further comprises a closed end forming a second base, opposite said first base.

17. The box according to claim 1, wherein said box is manufactured from a material selected from the group consisting of carton, paper, polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate, and a liquid crystal polymer, and any combination thereof.

18. The box according to claim 17, wherein:

said walls are a laminate of at least two sheets; and each of said sheet is formed of a material selected from the group consisting of carton, paper, polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate, and a liquid crystal polymer, and any combination thereof.

19. The box according to claim 1, wherein said box is a package for solid or semi-solid pharmaceutical dosage forms comprising one or more substances for treating tobacco dependence.

20. The box according to claim 19, wherein said solid or semi-solid pharmaceutical dosage form is selected from the group consisting of chewing gums, lozenges, and tablets.

21. The box according to claim 19, wherein said substance for treating tobacco dependence is nicotine and any form thereof.

22. The box according to claim 1, wherein said box is a package for solid or semi-solid pharmaceutical dosage forms.

23. The box according to claim 1, wherein the outside of a side wall of said inner casing and the inside of a corresponding side wall of outer casing both comprise a raised edge such that when said inner casing is in a retracted position in outer casing, the raised edge of the inner casing engages the corresponding raised edge on the inside of a corresponding side wall of outer casing.

* * * * *